US012584384B2

(12) United States Patent
Engel et al.

(10) Patent No.: US 12,584,384 B2
(45) Date of Patent: Mar. 24, 2026

(54) PERFORATING GUN TUBE AND PERFORATING GUN

(71) Applicant: Benteler Steel/Tube GmbH, Paderborn (DE)

(72) Inventors: Waldemar Engel, Paderborn (DE); Leonhard Rose, Borchen (DE); Christopher Halfpap, Paderborn (DE)

(73) Assignee: Benteler Steel/Tube GmbH (DE)

( * ) Notice: Subject to any disclaimer, the term of this patent is extended or adjusted under 35 U.S.C. 154(b) by 493 days.

(21) Appl. No.: 18/074,786

(22) Filed: Dec. 5, 2022

(65) Prior Publication Data

US 2023/0175360 A1 Jun. 8, 2023

(30) Foreign Application Priority Data

Dec. 6, 2021 (EP) ..... 21212558

(51) Int. Cl.

| | |
|---|---|
| ***E21B 43/116*** | (2006.01) |
| ***C22C 38/02*** | (2006.01) |
| ***C22C 38/22*** | (2006.01) |
| ***C22C 38/24*** | (2006.01) |
| ***C22C 38/28*** | (2006.01) |
| ***C22C 38/32*** | (2006.01) |
| ***C22C 38/38*** | (2006.01) |
| *E21B 43/119* | (2006.01) |

(52) U.S. Cl.

CPC ..... *E21B 43/116* (2013.01); *C22C 38/02* (2013.01); *C22C 38/22* (2013.01); *C22C 38/24* (2013.01); *C22C 38/28* (2013.01); *C22C 38/32* (2013.01); *C22C 38/38* (2013.01); *E21B 43/119* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 6,464,019 | B1 | 10/2002 | Werner et al. | |
| 9,903,008 | B2 | 2/2018 | Niikura et al. | |
| 11,085,277 | B2 * | 8/2021 | Lömker | E21B 43/116 |
| 2010/0193085 | A1 | 8/2010 | Garcia et al. | |
| 2011/0259482 | A1 * | 10/2011 | Peters | C21D 9/085 148/590 |
| 2012/0211131 | A1 | 8/2012 | Altschuler et al. | |
| 2012/0211132 | A1 | 8/2012 | Altschuler et al. | |
| 2016/0305192 | A1 | 10/2016 | Bühler et al. | |

FOREIGN PATENT DOCUMENTS

| | | |
|---|---|---|
| DE | 102007023306 | 11/2008 |
| DE | 102015111150 | 1/2017 |
| DE | 102015119839 | 5/2017 |
| DE | 112017006053 | 9/2019 |

* cited by examiner

*Primary Examiner* — Jophy S. Koshy
(74) *Attorney, Agent, or Firm* — Pandiscio & Pandiscio

(57) ABSTRACT

The present invention relates to a perforating gun tube, characterized in that the tube is made of a steel alloy comprising, in addition to iron, the following alloying elements, expressed in mass percent:

C 0.12-0.22%
Si 0.3-1.0%
Mn 1.0-4%
Cr 0.5-2%
Mo 0.1-1%,
V 0.05-0.2%
Ti 0.02-0.1% and
B 0.001-0.01%
and impurities due to melting, and that the tube has a yield strength, $R_{P0,2}$, in the range of 750 to 1100 MPa. In addition, a perforating gun having such a perforating gun tube is described.

18 Claims, 1 Drawing Sheet

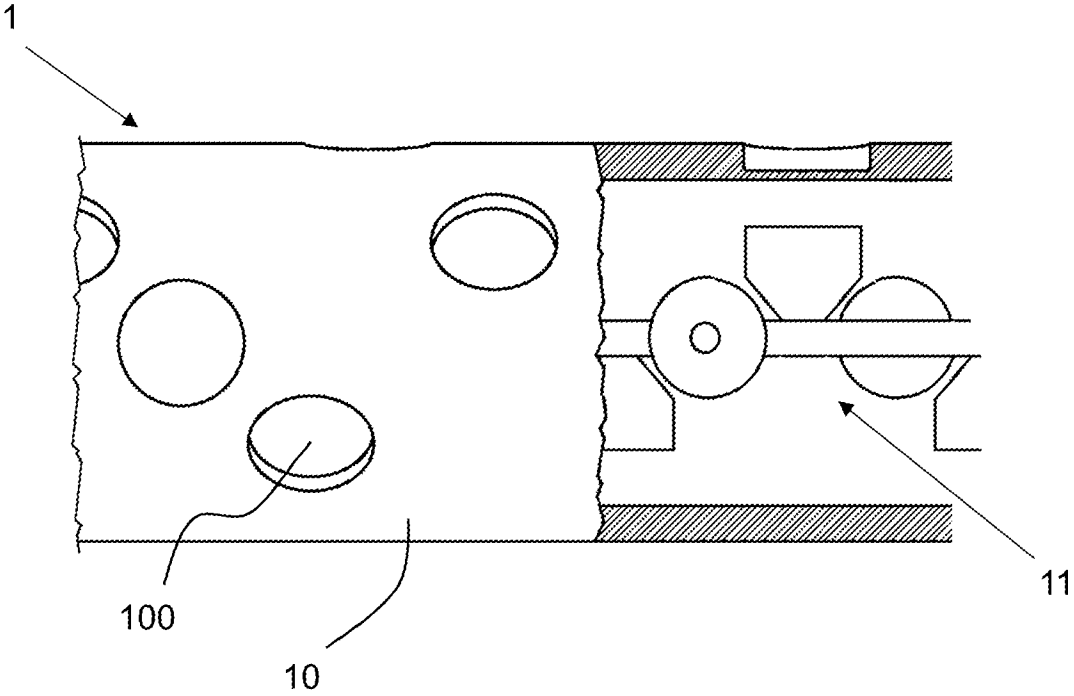
1
100
10
11

PERFORATING GUN TUBE AND PERFORATING GUN

REFERENCE TO PENDING PRIOR PATENT APPLICATION

This patent application claims benefit of European Patent Application No. 21212558.7, filed 6 Dec. 2021, which patent application is hereby incorporated herein by reference.

FIELD OF THE INVENTION

The present invention relates to a perforating gun tube and a perforating gun having a perforating gun tube.

BACKGROUND OF THE INVENTION

Perforating guns, also known as Perforating Guns or PerfGuns, are used to activate boreholes for oil and gas extraction. In this process, a targeted detonation is used to destroy the surrounding rock in the borehole to make it more permeable to the fluid, i.e. oil or natural gas. The outer tube of the perforating gun is also called a hollow carrier. The outer tube has the task of holding the perforating gun in place during detonation and must not be destroyed or significantly deformed in the process to prevent plugging of the borehole. This requires a high resistance of the outer tube material to the extreme loads.

It is therefore the object of the present invention to provide a perforating gun and, in particular, a perforating gun tube which reliably withstands these loads.

According to a first aspect, this task is solved by a perforating gun tube, which is characterized in that the tube is made of a steel alloy comprising, in addition to iron, the following alloying elements, specified in mass percent:

C 0.12-0.22%
Si 0.3-1.0%
Mn 1.0-4%
Cr 0.5-2%
Mo 0.1-1%,
V 0.05-0.2%
Ti 0.02-0.1% and
B 0.001-0.01%
and impurities due to melting, and
that the tube has a yield strength, $R_{P0,2}$, in the range of 750 to 1100 MPa.

The perforating gun tube is also called a tube or pipe.

The steel alloy is also referred to as material or alloy in the following. Contents of alloying elements are given in percentages by mass, but are designated only by percentages where appropriate. Impurities due to melting are unavoidable impurities which occur during the production of the alloy.

SUMMARY OF THE INVENTION

According to the invention, a perforating gun tube is a tube of a perforating gun. In particular, the perforating gun tube preferably represents the outer tube of a perforating gun and may also be referred to as a hollow carrier. Hereinafter, the perforating gun will also be referred to as PerfGun or Perforating Gun. The tube is preferably seamlessly manufactured from a solid block or hollow block, for example, by a conventional push-bank process or the well-known Mannesmann rolling process, and optionally a stretch-reducing rolling.

The tube according to the invention has a yield strength, $R_{P0.2}$, of at least 750 MPa, in particular in the range of 800 to 1100 MPa. Preferably, the tube has a yield strength, $R_{P0,2}$, in the range of 850 to 1050 MPa. These yield strength values can be achieved with the material used according to the invention. Thus, the invention achieves an increase in the resistance of the alloy and thus of the tube to failure under highly dynamic load, in particular during explosion. In addition, the tube preferably has a high strength, large enough to withstand the ambient pressure of the PerfGun before the explosion.

Preferably, the tube has a tensile strength $R_m$ of at least 1100 MPa preferably up to a maximum of 1400 MPa.

Preferably, the tube has a yield strength ratio $R_e/R_m$ of less than 0.9, preferably less than 0.87, more preferably 0.8 or 0.7.

Preferably, the tube has a breaking elongation of more than 10%, preferably more than 16%.

The yield strength, $R_{p0.2}$, which can also be referred to as substitute or offset yield strength, the tensile strength $R_m$, the yield strength $R_e$ as well as the breaking elongation are determined according to DIN EN ISO 6892-1:2020-06 (at room temperature).

The tube preferably has an air-hardened, bainitic structure. As a result, the perforating gun tube has properties that take into account the loads of the perforating gun. Advantages compared to conventionally quenched and tempered perforating gun tubes are, in addition to the reduced energy consumption due to the saved heat treatment steps of hardening annealing and tempering.

Preferably, a bainitic microstructure is one that comprises at least 70 area percent bainite. The microstructure may further comprise martensite, austenite and/or ferrite. The tube according to the invention is preferably hardened in air after a heat treatment. Preferably a cooling rate of 4 to 6 K/s, preferably 5 K/s is used in this process.

Preferably, the tube was subjected to at least one cold forming step after air hardening. In this way, the dislocation density can be increased. The cold forming step preferably represents a straightening of the tube. In particular, this can further increase the yield strength of the perforating gun tube.

The perforating gun tube can have several, in particular locally limited sections of reduced wall thickness, which serve as predetermined breaking points. These locally limited sections preferably represent punctiform or circular sections. Preferably, the tube comprises at least one predetermined breaking point in the form of a reduced wall thickness. The predetermined breaking point may in particular be a circular depression on the outside or the inside of the tube. The locally confined sections, that is the predetermined breaking points, are provided in the perforating gun tube for forming wall openings at the perforating gun tube upon ignition of ignition charges introduced into the perforating gun tube. Due to the large energy absorption capacity of the steel alloy according to the invention, of which the perforating gun tube is made, it can be ensured that the perforating gun tube does not burst when the ignition charges are ignited. Only the areas of reduced wall thickness are broken up, thus allowing perforating of the surrounding rock.

In the alloy according to the invention, carbon is present in a range between 0.12 and 0.22 mass %. Carbon ensures a hardening of the material. If the carbon content is too low, i.e. if it is in particular below 0.12%, the strength of the alloy is too low, i.e. the strength required for the loads of a PerfGun cannot be achieved. If, on the other hand, the carbon content is too high, that is to say if it is above 0.22 mass %, the weldability of the material and thus of the PerfGun made from the material is impaired. Moreover, with the carbon contained according to the invention, a strength of the material can be achieved for which the addition of expensive alloying elements, such as molybdenum, even in small amounts can be sufficient to increase the strength. In one embodiment, the carbon content of the alloy is between 0.15-0.22%, preferably 0.17 and 0.2 mass %. In this range, the above-mentioned effects of the carbon can be used particularly well, or its negative influences can be limited.

According to the invention, silicon is present in an amount of 0.3-1.0 mass %, preferably 0.3-0.9 mass %. The addition of silicon in this range results in an increase in the strength of the alloy according to the invention by solid solution strengthening. In addition, an increase in the through-hardenability of the material and thus an increase in strength is also achieved by silicon. However, the effect of silicon is weaker than that of chromium or manganese. Therefore, according to the invention, at least 0.3 mass % silicon is contained in the alloy. If the silicon content is too low, the required strength of the perforating gun tube is not achieved. If the silicon content is too high, increased segregation occurs and, associated with this, the risk of cracks during hardening or cold processing. The silicon content in the alloy according to the invention is therefore at most 1.0 mass %. In one embodiment, the silicon content of the alloy is between 0.4 and 0.85 mass %, preferably between 0.5 and 0.7 mass %. In these ranges, the above-mentioned effects of the silicon can be used particularly well, or its negative influences can be limited.

According to the invention, manganese is present in the alloy in an amount of 1.0-4 mass %, preferably 1.2-3.5 mass %. The addition of manganese increases the through-hardenability of the material and achieves an increase in strength. The addition of manganese in the specified amount also achieves air-hardening properties of the material. Furthermore, manganese contributes to increasing the strength by solid solution strengthening, which is also referred to as Solid Solution Strengthening. In one embodiment, the manganese content of the alloy is between 1.4 and 3.0 mass %, preferably between 1.6 and 2.5 mass %, more preferably between 2.0 and 2.3 mass %. In these ranges, the above-mentioned effects of the manganese can be used particularly well.

According to the invention, chromium is present in an amount in the range from 0.5 to 2 mass %. Hereby, on the one hand, the increase in the through-hardenability of the material and the increase in the strength are achieved. On the other hand, air-hardening properties are achieved by the addition of chromium in the amount indicated. According to the invention, the amount of chromium is limited to a maximum of 2 mass %. A higher chromium content may result in precipitation of chromium carbides and thus in deterioration of the weldability. In one embodiment, the chromium content of the alloy is between 0.5 and 1.5 mass %, for example between 1.0 and 1.8 mass % and in particular from 1.3 and 1.5 mass %. In this range, the above-mentioned effects of the chromium can be used particularly well, or its negative influences can be limited.

According to the invention, molybdenum is present in the alloy in an amount of 0.1 to 1 mass %. By adding molybdenum, the through-hardenability of the material can be further increased and the increase in strength can be achieved. In addition, molybdenum, like also vanadium, can improve the tempering resistance. Finally, molybdenum causes a reduction in the tendency to embrittlement when subjected to a thermal stress, also known as a tempering embrittlement. In particular, a 500° C.-embrittlement can be avoided. In one embodiment, the molybdenum content of the alloy is between 0.1 and 0.7 mass %, for example between 0.14 and 0.7 mass %, in particular between 0.17 and 0.3 mass %. In this range, the above-mentioned effects of the molybdenum can be used particularly well, or its negative influences can be limited.

According to the invention, vanadium is present in amounts of at least 0.05 to 0.2 mass %. By adding vanadium in these amounts, the tempering resistance can be increased. In addition, a deterioration of the mechanical characteristic values, in particular the strength and deformation characteristic values, after thermal stress is reduced by the formation of vanadium carbonitrides. Furthermore, the targeted addition of vanadium supports the air hardenability of the alloy. In one embodiment, the vanadium content of the alloy is between 0.05 and 0.15 mass %, preferably between 0.06 and 0.15 mass %. In this range, the above-mentioned effects of vanadium can be used particularly well, or its negative influences can be limited.

Titanium is present in an amount in the range of 0.02-0.1 mass %. By adding titanium, any nitrogen present in the alloy, which may be present, for example, if vacuum degassing is not used, can be bound. Thus, the formation of boron nitrides is prevented and the effect of boron, in particular the hardenability-increasing effect, can be utilized. If less than 0.02 mass % titanium is present in the alloy, or if no titanium is present, boron nitrides would be formed and thus the hardenability increasing effect of boron could no longer be used. In one embodiment, the titanium content of the alloy is between 0.03 and 0.1 mass %, preferably between 0.04 and 0.08 mass %. In this range, the above-mentioned effects of the titanium can be used particularly well, or its negative influences can be limited.

According to the invention, boron is contained in the alloy in a range of 0.001-0.01 mass %. This further enhances the increase in the through-hardenability of the material. In one embodiment, the boron content of the alloy is between 0.001 and 0.006 mass %, preferably between 0.0015 and 0.0025 mass %. In this range, the above-mentioned effects of boron can be used particularly well.

The alloy according to the invention thus creates a temper-resistant material, which also ensures hardening of the material, exhibits increased strength and can still be welded. In addition, the material exhibits increased through-hardenability, which further increases the strength. Furthermore, the alloy according to the invention also exhibits air-hardening properties and the tendency to embrittlement is reduced.

Finally, the alloy according to the invention exhibits high temperature resistance. Due to the low contents of chromium, vanadium as well as molybdenum present in the alloy according to the invention, the costs are also reduced.

According to one embodiment, the steel alloy, expressed in mass percent, consists of:

C 0.17-0.20%
Si 0.5-0.7%
Mn 1.7-2.2%
Cr 0.6-1.4%
Mo 0.1-0.2%
V 0.05-0.10%
Ti 0.03-0.08%
B 0.0010-0.0030%
balance iron and impurities due to melting. A tube made of this steel alloy according to the invention has a yield strength Re of at least 800 MPa—even more than 850

MPa in the straightened state—and a tensile strength Rm of at least 1150 MPa and a yield strength ratio $R_e/R_m$ of less than 0.80.

According to one embodiment, the steel alloy consists of, stated in mass percent:

C 0.18%
Si 0.6%
Mn 2.1%
Cr 0.6-1.4%
Mo 0.1-0.2%
V 0.07%
Ti 0.05%
B 0.0020%
remainder iron and impurities due to melting.

The following steel alloys have proven to be particularly suitable:

Alloy 1:
c 0.18%
Si 0.6%
Mn 2.1%
Cr 1.4%
Mo 0.2%
V 0.07%
Ti 0.05%
B 0.0020%
remainder iron and impurities due to melting.

Alloy 2:
C 0.18%
Si 0.6%
Mn 2.1%
Cr 0.6%
Mo 0.2%
V 0.07%
Ti 0.05%
B 0.0020%
remainder iron and impurities due to melting.

Alloy 3:
C 0.18%
Si 0.6%
Mn 2.1%
Cr 0.6%
Mo 0.1%
V 0.07%
Ti 0.05%
B 0.0020%
remainder iron and impurities due to melting.

The alloy used according to the invention may comprise, in addition to the alloying elements indicated, at least one of the following alloying elements in the ranges indicated in mass percent:

Al 0.03-0.05%
Ni max. 0.2%
Cu max. 0.22%
Sn max. 0.02%
P max. 0.015%
S max. 0.003%
N max 0.014%.

According to one embodiment, the tube consists of a steel alloy, which consists of the following alloying elements, specified in mass percent:

C 0.12-0.22%
Si 0.3-1.0%
Mn 1.0-4%
Cr 0.5-2%
Mo 0.1-1%,
V 0.05-0.2%
Ti 0.02-0.1%
B 0.001-0.01%
Al 0.03-0.05%
Ni max. 0.2%
Cu max. 0.22%
Sn max. 0.02%
P max. 0.015%
S max. 0.003%
N max. 0.014%
remainder iron and impurities due to melting.

According to one embodiment, the tube consists of a steel alloy, which consists of the following alloying elements, specified in mass percent:

C 0.12-0.22%
Si 0.5-0.7%
Mn 1.2-3.5%
Cr 1.0-1.8%
Mo 0.1-1%,
V 0.05-0.2%
Ti 0.02-0.1%
B 0.001-0.01%
Al 0.03-0.05%
Ni max. 0.2%
Cu max. 0.22%
Sn max. 0.02%
P max. 0.015%
S max. 0.003%
N max. 0.014%
remainder iron and impurities due to melting.

According to one embodiment, the tube consists of a steel alloy, which consists of the following alloying elements, specified in mass percent:

C 0.12-0.22%
Si 0.5-0.7%
Mn 1.2-3.5%
Cr 1.0-1.8%
Mo 0.1-1%,
V 0.05-0.2%
Ti 0.02-0.1%
B 0.001-0.01%
Ni max. 0.2%
Cu max. 0.22%
Sn max. 0.02%
P max. 0.015%
S max. 0.003%
N max. 0.014%
remainder iron and impurities due to melting.

According to a further aspect, the invention relates to a perforating which is gun characterized in that it comprises a perforating gun tube according to the invention. Preferably, the perforating gun tube constitutes the outer tube of the perforating gun tube.

Advantages and features explained with respect to the perforating gun tube according to the invention also apply—as far as applicable—to the perforating gun and vice versa, and are explained only once, where appropriate.

BRIEF DESCRIPTION OF THE DRAWINGS

The present invention will now be further explained with reference to the accompanying drawings. Showing:

FIG. 1: a schematic representation of a perforating gun with a perforating gun tube.

DETAILED DESCRIPTION OF THE PREFERRED EMBODIMENTS

FIG. 1 schematically shows an embodiment of the perforating gun 1. The perforating gun 1 comprises a perforating gun tube 10, which may also be referred to as a hollow carrier. Preferably, the perforating gun tube 10 constitutes a seamless tubular element. Locally confined regions 100 having a reduced wall thickness are introduced in the perforating gun tube 10. The locally confined regions 100 each have a circular area. The regions 100 are distributed along the length of the perforating gun tube 10. An ignition unit 11 with ignition charges is inserted in the perforating gun tube 10. By means of the ignition unit 11, the explosive material of the ignition charge is ignited and thereby, on the one hand, the regions 100 of the perforating gun tube 10 are opened and, on the other hand, the surrounding material, for example rock, is perforated.

LIST OF REFERENCE SIGNS

1 Perforating gun
10 Perforating gun tube
100 Region of lower wall thickness
11 Ignition unit

The invention claimed is:

1. A perforating gun tube, characterized in that the tube is made of a steel alloy comprising, in addition to iron, the following alloying elements, expressed in percent by mass:
C 0.12-0.22%
Si 0.3-1.0%
Mn 1.0-4%
Cr 0.5-2%
Mo 0.1-1%,
V 0.05-0.2%
Ti 0.02-0.1% and
B 0.001-0.01%
and impurities due to smelting, and
wherein the tube has a yield strength, $R_{p0.2}$, in the range from 750 to 1100 MPa; and
wherein the tube has an air-hardened bainitic microstructure comprising at least 70 area percent bainite.

2. A perforating gun comprising a perforating gun tube, characterized in that the tube is made of a steel alloy comprising, in addition to iron, the following alloying elements, expressed in percent by mass:
C 0.12-0.22%
Si 0.3-1.0%
Mn 1.0-4%
Cr 0.5-2%
Mo 0.1-1%,
V 0.05-0.2%
Ti 0.02-0.1% and
B 0.001-0.01%
and impurities due to smelting, and
wherein the tube has a yield strength, $R_{p0.2}$, in the range from 750 to 1100 MPa; and
wherein the tube has an air-hardened bainitic microstructure comprising at least 70 area percent bainite.

3. The perforating gun tube of claim 1, wherein the tube has a yield strength, $R_{p0.2}$, in the range of 850 to 1050 MPa.

4. The perforating gun tube of claim 1, wherein the tube has a tensile strength Rm of at least 1100 MPa.

5. The perforating gun tube of claim 1, wherein the tube has a yield strength ratio Re/Rm of less than 0.9.

6. The perforating gun tube according to claim 1, wherein the tube has a breaking elongation of more than 10%.

7. The perforating gun tube of claim 1, wherein the tube has been subjected to at least one straightening step after manufacture.

8. The perforating gun tube of claim 1, wherein the tube has at least one predetermined breaking point in the form of a reduced wall thickness.

9. The perforating gun tube according to claim 1, wherein the carbon content is in the range of 0.15-0.22 mass %.

10. The perforating gun tube according to claim 1, wherein the silicon content is in the range of 0.4 to 0.85 mass %.

11. The perforating gun tube according to claim 1, wherein the manganese content is in the range from 1.4 to 3.0 mass %.

12. The perforating gun tube according to claim 1, wherein the chromium content is in the range of from 0.5-1.8 mass %.

13. The perforating gun tube according to claim 1, wherein the molybdenum content is in the range of 0.14-0.7 mass %.

14. The perforating gun tube according to claim 1, wherein the vanadium content is in the range of 0.05-0.15 mass %.

15. The perforating gun tube according to claim 1, wherein the titanium content is in the range of 0.03-0.1 mass %.

16. The perforating gun tube according to claim 1, wherein the boron content is in the range of 0.001-0.006 mass %.

17. The perforating gun tube according to claim 1, characterized in that the steel alloy consists of, expressed in mass percent:
C 0.17-0.20%
Mn 1.7-2.2%
Si 0.5-0.7%
Cr 0.6-1.4%
V 0.05-0.10%
B 0.0010-0.0030%
Ti 0.03-0.08%
Mo 0.1-0.2%
remainder iron and impurities due to smelting.

18. The perforating gun of claim 2, wherein the perforating gun tube is an outer tube of the perforating gun.

* * * * *